United States Patent [19]

Wolf

[11] Patent Number: 4,765,101

[45] Date of Patent: Aug. 23, 1988

[54] LEAVES AWAY FOR GUTTERS

[76] Inventor: Paul F. Wolf, 466 Wyndmoor La., Huntingdon Valley, Pa. 19006

[21] Appl. No.: 4,976

[22] Filed: Jan. 20, 1987

[51] Int. Cl.[4] ..... E04D 13/06

[52] U.S. Cl. ..... 52/12

[58] Field of Search ..... 52/11, 12; 210/473, 210/474

[56] References Cited

U.S. PATENT DOCUMENTS

| | | | |
|---|---|---|---|
| 1,308,311 | 7/1919 | Ward | 52/12 |
| 2,175,138 | 10/1939 | Westlake | 52/12 |
| 2,284,440 | 5/1942 | Morrissey | 52/12 |
| 2,805,632 | 9/1957 | Couture | 52/12 |
| 2,988,226 | 6/1961 | Campbell | 52/12 X |
| 4,032,456 | 6/1977 | Berce | 52/12 |
| 4,036,761 | 7/1977 | Rankin | 52/12 X |
| 4,351,134 | 9/1982 | Clarkson | 52/12 |
| 4,395,852 | 8/1983 | Tang | 52/12 |
| 4,418,504 | 12/1983 | Lassiter | 52/12 |
| 4,455,791 | 6/1984 | Elko et al. | 52/12 |
| 4,497,146 | 2/1985 | Demartini | 52/12 |
| 4,604,837 | 8/1986 | Beam | 52/12 |

*Primary Examiner*—J. Karl Bell

*Attorney, Agent, or Firm*—William Lawrence Muckelroy

[57] ABSTRACT

A drain shield for gutters or the like with one part adapted to prevent leaves, pine needles and other debris from entering the gutters and causing them to clog and require periodic cleaning and maintenance and another part adapted to dam rainwater and other precipitation, re-direct the flow of the precipitation and inhibit water from flowing over the edge of the gutter.

10 Claims, 3 Drawing Sheets

LEAVES AWAY FOR GUTTERS

BACKGROUND OF THE INVENTION

1. Field of the Invention

This novel invention relates to a drain and gutter assembly, and more particularly to a novel shield for a drain and gutter assembly additionally constituted to provide a substantially vertical flange which acts as a dam to prevent the flow of excess rainwater and the like over an edge of the gutter.

2. Description of the Prior Art

The following issued patents comprise a portion of the developed pertinent prior art related to this invention, to wit: U.S. Pat. No. 1,308,311 issued to Ward on July 1, 1919; U.S. Pat. No. 2,175,138 issued to Westlake on Oct. 3, 1939; U.S. Pat. No. 2,284,440 issued to Morrissey on May 26, 1942; U.S. Pat. No. 2,805,635 issued to Couture for a gutter screen fastener on Sept. 10, 1957; U.S. Pat. No. 4,032,456 issued to Berce for a flip up gutter shield on June 28, 1977; U.S. Pat. No. 4,351,134 issued to Clarkson for a hinged gutter guard on Sept. 28, 1982; U.S. Pat. No. 4,395,852 issued to Tang for a gutter guard on Aug. 2, 1983; U.S. Pat. No. 4,418,508 issued to Lassiter for a drain shield for gutters on Dec. 6, 1983; and, U.S. Pat. No. 4,455,791 issued to Elko, et al. for a protective cover for gutters on June 26, 1984.

None of the above cited patent references disclose a construction of a drain and gutter shield with a means for damming water from overflowing over the edge of said gutter or which is similar to or anticipatory of the novel construction and assembly of the invention described herein.

In 1919, Ward patented a new and useful improvement to an eaves trough protector which provided a simple, strong and effective device for protecting eaves troughs from becoming clogged with leaves or other light debris by preventing such objectionable matter from entering the eaves trough without preventing free admission of the drainage water from the roof. An essential aspect of this invention was to provide a device, readily removable if desired, to present ready access to the trough to clean out any dirt or other finely divided material which may pass through the protector. Westlake, in his 1939 patent, made a significant improvement by providing a stranded eaves protector wherein the strands were diagonally disposed with respect to the longitude of the eaves trough.

In U.S. Pat. No. 2,284,440 Morrissey provided an eave trough protector which was of light weight and which could be formed in and was capable of being applied in one continuous piece throughout the length of the eaves trough or gutter and thereby eliminate overlaps, seams, and splicing which has been employed prior to that time in screen type protectors.

Couture, in his gutter screen fastener patented in 1957, provided a mounting clip adapted for positioning upon relatively short lengths of the gutter screen and thereby provided means for securing a screen to a gutter flange. On the other hand, Burce, in 1977, provided the first flip up gutter shield capable of being flipped and moved to a position away from the gutter for servicing of the gutter. The Berce patent provided a flip up gutter shield which, when in the flipped up position, was completely out of the way of the person servicing the gutter. It facilitated ease of painting.

Clarkson provided an improvement over the flip up gutter shield of Berce. Clarkson provided a hinge gutter guard in the form of an elongated perforated cover plate made of relatively rigid sheet material and equipped along one longitudinal edge with a plurality of hinge straps adapted to be secured to a roof beneath the lower course of shingles thereof.

Tang, on the other hand, provided a gutter guard for an open top gutter mounted on the eaves of a building of the type having a roof covering with a peripheral edge of the roof covering adjacent to the gutter arranged so that it could be lifted slightly to receive a portion of the gutter guard. A key difference of Tang, over the prior art, is that a plastic sheet is divided longitudinally into portions, each portion adapted to be alternatively positioned under the peripheral edge of the roof covering with the other portion positioned over the gutter. The outer longitudinal edges of this sheet are formed with a narrow bendable flaps defined by fold lines and the portions of this sheet are separated by another fold line. A clip fits over the top rim of the gutter and receives the edge of the guard and its flap to hold the guard in position on the gutter.

Lassiter's drain shield for gutters is concerned with a drain shield to prevent leaves, pine needles and the like from entering the gutters and causing them to clog and required periodic cleaning and maintenance. The unique feature of the Lassiter patent is that his drain shield allows rainwater to easily enter the gutters while causing leaves, twigs and other debris to be washed over the edge of the gutter to be ground below. Also unique to Lassiter is the way in which the perforations are formed in the gutter shield.

Elko also provides a protective cover for gutters which includes an elongated and pervious sheet, wide enough to extend across at least 90% of the width of the gutter and up under a lower edge of the roofing material. However, the outer edge of the Elko cover curls downwardly and the water flow follows the curvature by surface tension to cascade into the gutter. The problem with the Elko protective gutter, which is solved by the present novel invention, is that the volume of water increases to a predeterminable level as it flows over the gutter sheld. The volume of water becomes so great such that the surface tension is insufficient to cause all of the water to flow into the gutter. Similarly, in Lassiter and Clarkson with a predetermined level of water flow over the gutter shield, the volume becomes so great so as to cause water to flow over the edge of the gutter shield and thereby substantially diminish the function of the gutter and downspout for directing precipitation off of the roof of the dwelling.

The overflowing of water over the peripheral edge of the gutter shield of both Lassiter and Clarkson is alleviated by the novel means of the present invention which retains this excess flow of water and causes same to accumulate and then flow through the perforations made available in the gutter guard and by directing the water flow along the drain shield or gutter guard.

OBJECTS OF THE INVENTION

Roof gutters are constantly in need of cleaning as a result of leaves, pine needles, twigs and other debris which are washed from the roof during rain storms. Homeowners are particularly plagued during the fall season as leaves fall from nearby trees to fill the gutters and block downspouts, causing the gutters to overflow. To alleviate this problem, prior art devices have been developed which include screens and other apparatus to stop leaves from entering the gutter and straining devices which prevent the leaves once they have entered the gutter to pass into and down the downspout.

With this background in mind, the present invention was developed and one of its objectives is to provide a gutter shield with a rain dam wherein excessive water from heavy rains is contained by the gutter shield and either allowed to drain in delayed fashion or directed towards the end of the gutter to the downspout.

Accordingly, it is the object of the present invention to provide a gutter shield which does not allow leaves and debris to pass over the edge of the gutter and which further does not allow rainwater to pass uninterrupted over the edge of the gutter but, instead, directs rainwater during heavy downpours towards an end of the gutter covered by a gutter shield to facilitate its direct passage through the downspout of the gutter to the ground.

SUMMARY OF THE INVENTION

The invention, as disclosed herein, is a gutter shield for positioning on a drain gutter of a house or other building. The shield consists of a planar member which may be made of galvanized sheet metal, plastic, aluminum, copper, or other suitable materials. The planar member has a dispersed series of perforations or apertures and along its edge a series of slots. At the edge thereof, the planar member has a vertical wall member for directing the flow of rainwater along the gutter shield to each end thereof during heavy rain downpourings. A heavy flow of rainwater enters the apertures as well as flows down the gutter to the downspout without undue interference from solid materials, leaves, etc. The vertical wall member at the distal edge of the shield provides a trough means whereby liquid is guided in heavy downpours toward the ends of the gutter to the vicinity of the downpipe.

DESCRIPTION OF THE PREFERRED EMBODIMENT

Figure 1:
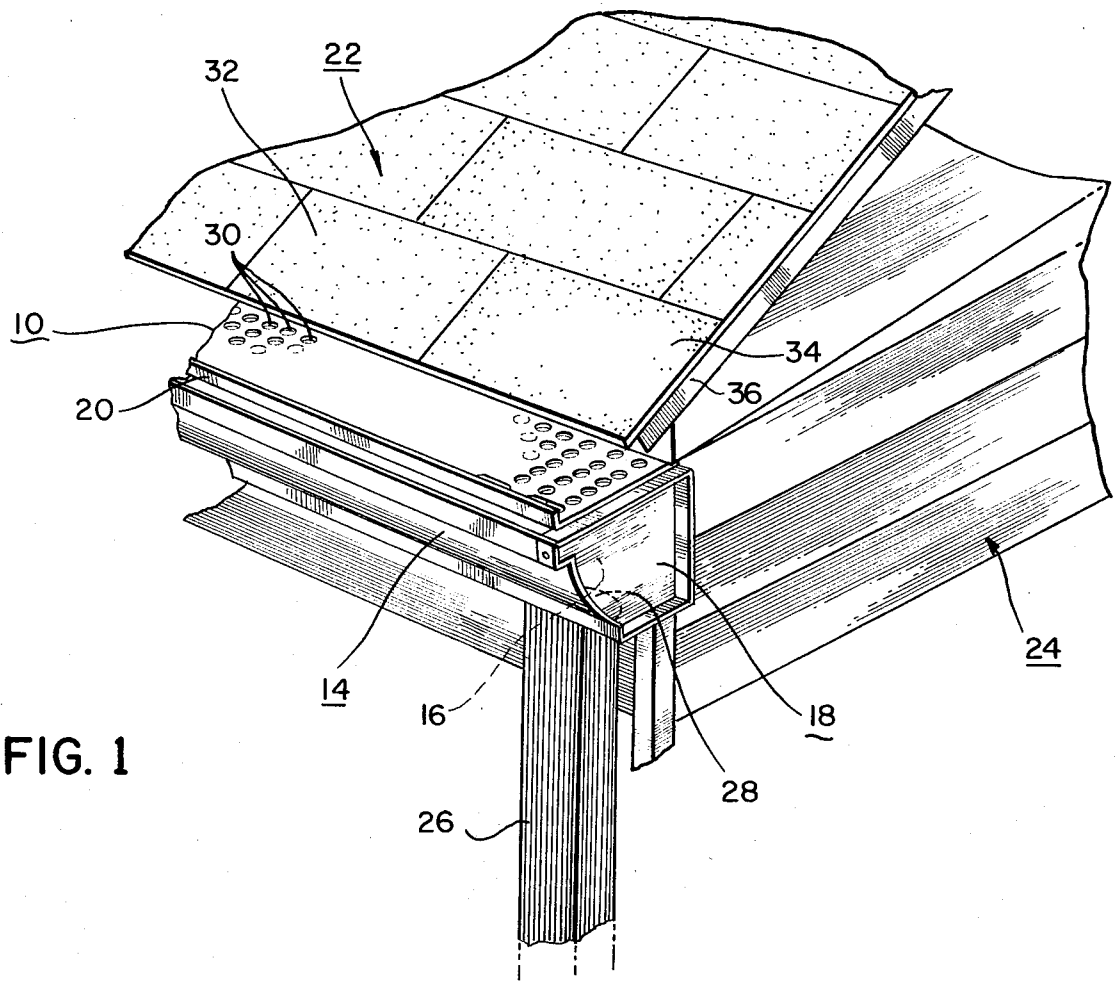
FIG. 1 demonstrates the preferred embodiment of the drain shield positioned on a drain gutter.

In the drawings, like reference characters designate similar parts in the several views of the invention shown in the drawings.

Referring now to FIG. 1 of the drawings, there is shown a section of a shield 10 of the preferred embodiment of the drain shield of the present invention which may be formed, for example from metals, plastics, or other suitable materials. As many sections as desired may be placed along the gutter 14 to insure full protection of the gutter 14 substantially along its entire length. However, a cavity 16 is formed inside the gutter 14 sufficient to contain the flow of water.

Shown in FIG. 1 is an end member 18 attached to the drain shield 10 and the gutter 14. The cavity 16 is a hollow space adapted to receive run off from the shield 10. Rainwater flowing along the surface of the shield 10 is directed towards a down pipe 26 by the patch of the gutter 14 in conjunction with a wall 20 substantially vertically oriented.

A roof 22 is shown attached to a house 24. Attached to the house 24 and roof 22 is the gutter 14. Shown attached to the gutter 14 is the down pipe 26. The down pipe 26 has an upper aperture 28 through which rainwater, draining from the shield 10, flows to the ground (not shown).

The shield 10 has a plurality of perforations 30 disposed about the shield 10, either randomly or in a specific pattern such as that shown, for example.

The drain shield 10 may also be adapted to be inserted underneath the lower most shingles, for example shingles 32 and 34 covering the edge of the roof 22 of the house 24 inbetween the shingles 32 and 34 and an eave 36.

In a substantial downpouring of rain, such that a torrent of water flows over the shingles 32 and 34, for example, water is directed onto the shield 10. A portion of this water passes through the perforations 30 into the gutter 14.

Another portion of this water flows over the surface of the shield 10 and is blocked from flowing over the edge of the gutter 14 by the wall 20. The wall 20 in turn directs some of this water along the shield 10 until it falls through to the cavity 16 and then to the down pipe 26 by means of the pitch of the gutter 14 whereby it flows into the gutter 14 and subsequently down through the down pipe 26 via the aperture 28 for example.

Figure 2:
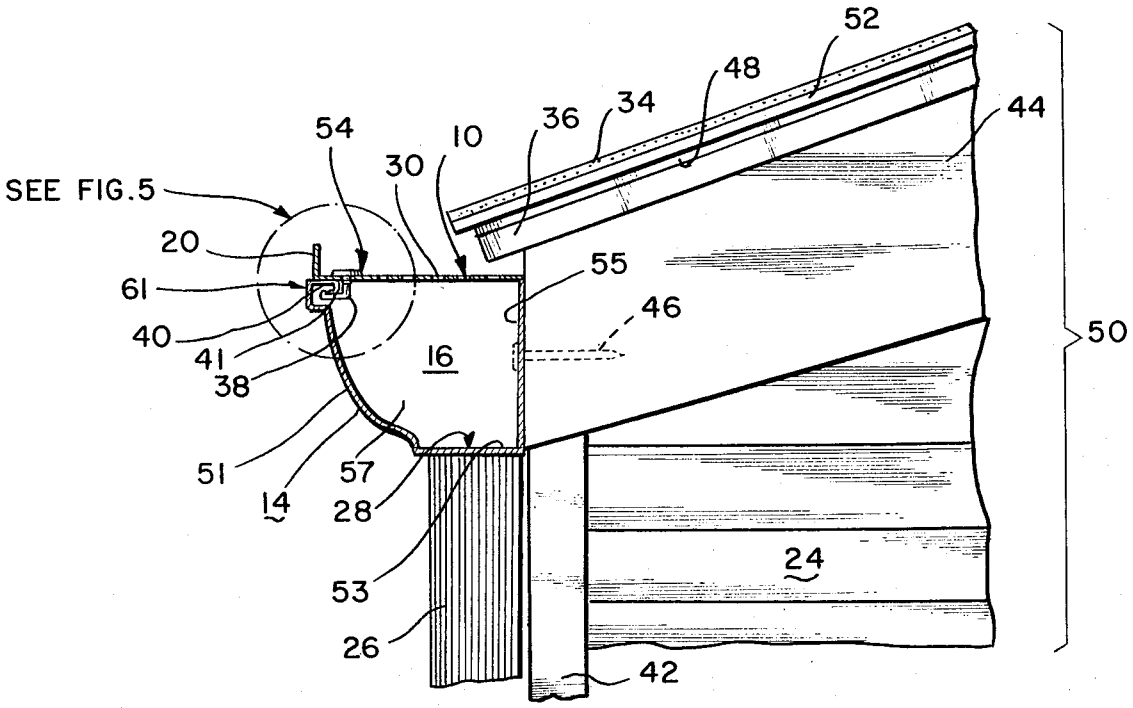
FIG. 2 illustrates a side elevational view of the drain shield shown in FIG. 1.

FIG. 2 is a partial cross-section of the gutter 14, drain pipe 26, and shield 10 assembled and attached under the eave 36 to the house 24. There is shown means for attachment of the shield 10 to the gutter 14. This means comprises for example, a specially adapted clamping pin 38. The clamping pin 38 is adapted to be inserted partially through one of a series of slots, for example slot 56 (shown in FIGS. 4 and 5), in the shield 10 and then snapped in to secure the shield 10 to a lip 40 of the gutter 14. A bulge 39 in the pin 38 is more clearly shown in FIGS. 5 and 6 and provides the snapping action for the pin 38 and slot 56 assembly.

FIG. 2 further shows a side view of the eave 36 of a building, for example the house 24. This structure includes a fascia or cornice 42 attached at an end of a rafter such as, for example the rafter 44. The gutter 14 is nailed to the end of the rafter 44 by a nail 46, for example. The rafter 44 supports the sheathing 48, a main structural member of the roof assembly 50.

The pitch of the roof may be as flat as 1 in 12 or even less, or as steep as 8 in 12, or even more, for example. Such sheathing 48 is typically made of about 0.9 centimeter or 1.2 centimeter plywood in current buildings. According to standard practice, the sheathing 48 is covered with a layer of roofing felt 52, typically of #15 weight. Layers of shingles 32 and 34 are nailed down. The underside of the eave 36 is covered by a plywood soffit (not shown). The gutter structure includes a gutter 14 having a front wall 51, a bottom wall 53, a rear wall 55, and end walls, for example, end wall 57.

Modern gutters of the type shown in FIG. 2 are referred to as O.G. gutters and are normally formed of galvanized sheet metal, aluminum or plastic. The upper end of the front wall 51 has a vertical portion 61 and an inwardly turned lip 40 that has an inner most edge 41. This lip 40 is at substantially the same level as the upper edge of the end wall 57. The drain pipe 26 leads water out of the gutter 14 and typically carries it to a drain or dry well (not shown) or simply out into the yard some distance from the house 24.

The gutter 14 is nailed to the house 24 by means of a series of spikes or nails 46 that extend through holes (not shown) in the rear wall 55. To provide proper spacing, which is typically 5 or 6 inches, between the rear wall 55 and the rafter 44, the nails 46 are sometimes enclosed in tubular metal ferrules (not shown).

Normally the lower most edges of the lowest level of shingles, for example shingle 34, extend out over the lower most edge of the roofing felt 52 so that water falling on the shingles runs directly into the gutter 14. While the water should run down the gutter 14 to downpipe 26, it has been found that it frequently carries twigs and leaves and other debris into the gutter 14 and either clogs up the downpipe 26 or builds up and dams the gutter to prevent the proper run off of water. In that case, water tends to flow over the lip 40 of the gutter 14 or even to back up into the building itself under the roofing felt 52.

To keep the gutter 14 and shield 10 from accumulating debris, the present invention combines the shield 10 and the wall 20 for damming water. Shown separately in FIG. 3, the wall 20 is in the form of an elongated shield that extends longitudinally along the gutter 14.

The edge which is bent to form the vertical wall 20 is located near the inwardly turned edge of the lip 40 (FIG. 2). The shield 10 is wider than the space between the lip 40 and the rear wall 55 of the gutter. The shield 10 is typically within a range of 14 centimeters to 20 centimeters wide and is preferably about 16.5 centimeters wide. It may be made of metal, such as aluminum or #26 gage galvanized iron, or it may be made of plastic. In the embodiment shown, the lip 40 has a width for its upper surface of about 1.2 centimeters and extends approximately 270 degrees around from the point at which it begins at the outer edge of the flat part of the shield 10.

Figure 3:
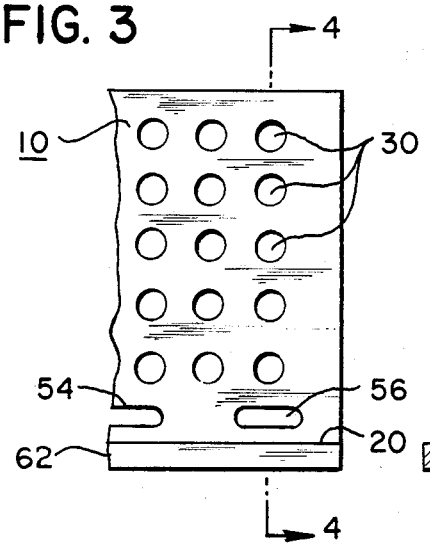
FIG. 3 illustrates a top plan view of the drain shield shown in FIG. 1.

FIG. 3 is a plan view of a portion of the shield 10 initially described above. The shield 10 has a plurality of holes therein for the drainage of rainwater therethrough such as, for example the pattern of apertures 30. There is also shown, as part of the shield 10, a plurality of slots 54 and 56 and others not shown. Near the slots 54 and 56, there is shown a vertical flange, for example the wall 20. The vertical flange operates as a rain dam and prevents the flow or inhibits the flow of rain water over the edge 62 of the shield 10.

Figure 4:
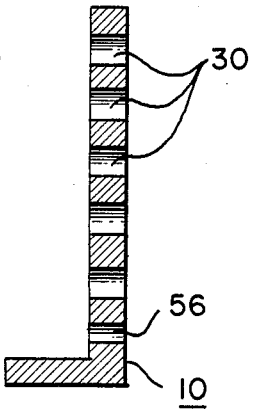
FIG. 4 illustrates a cross-sectional view of the drain shield shown in FIG. 3, taken along the line 4—4.

There is shown in FIG. 4 a side view of the shield 10 taken along the line 4—4 as shown in FIG. 3. The apertures 30 are shown along with a cross-section of the slot 56.

Figure 5:
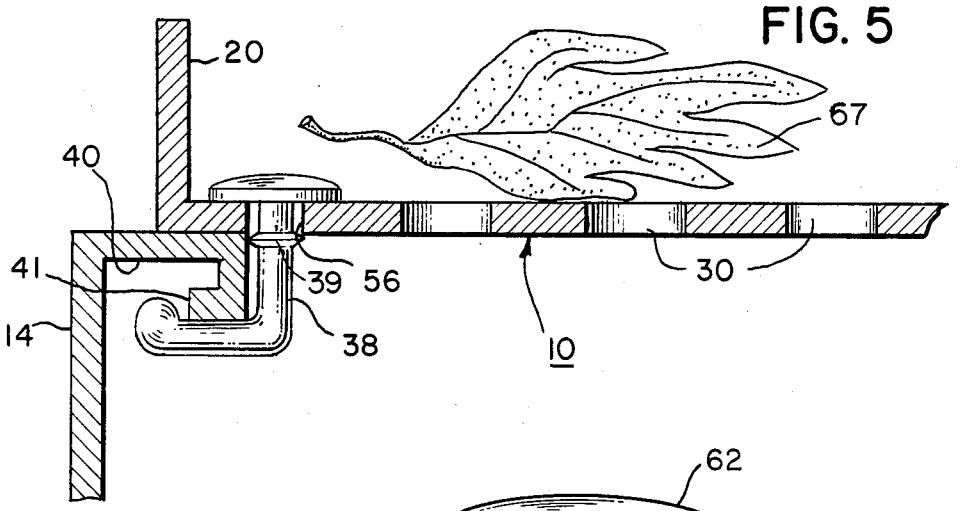
FIG. 5 illustrates a close-up sectional view of the drain shield shown in FIG. 2 and enclosed in the circle 5; and, FIG. 6 is an enlarged view of a clip adapted to attach the drain shield to a gutter.

Shown in FIG. 5 is a partial cross-section of an assembly of the shield 10, gutter 14 and clip member such as pin 38, for example. There is the wall 20 in cross-sectional view shown as an integral part of the shield 10. The apertures 30 are sized to prevent debris such as the leaf 67, for example, from flowing into the gutter 14. The size of each aperture 30, by area, is approximately one half square centimeter, for example.

Figure 6:
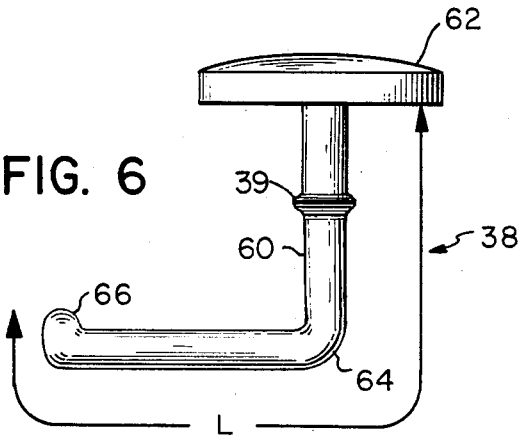

Shown in FIG. 6 is a detailed side view of the pin 38. The pin 38 has a shaft 60, which bulges into the bulge 39, and a head 62. The head 62 somewhat resembles a nail head and is sized such that it is round in shape and has a diameter substantially greater than the width of each slot, for example slots 54 and 56 shown in FIG. 3, each of which is adapted to receive this clamping pin 38. The shaft 60 of the clamping pin 38 has a length L equal to approximately 1 or 2 centimeters with a 90 degree bend at approximately halfway from the head 62. The shaft 60 also has another bend approximately at the tip thereof. The pin 38, shown in FIG. 6, is adapted to snap through and fit snugly around the innermost edge 41 and lip 40 in the fashion as specifically shown in FIG. 5 such that the pin 38 functions as a means for clamping the drain shield 10 to the gutter 14.

Other features, advantages and objects of the invention will become apparent from the specification as read specifically in conjunction with the drawings which depict the preferred embodiment of the invention.

While the foregoing preferred embodiment of the invention has been set forth in considerable detail for purposes of illustration, it is to be understood by those skilled in the art, that many of these details may be varied without departing from the scope of this invention and, the inventor hereof hereby invokes the doctrine of equivalents insofar as applicable.

What is claimed is:

1. In a drain and gutter assembly with end members comprising a planar base member having an inner edge adjacent a roof and an outer edge away from said roof and having upper and lower surfaces and adapted to be installed on a roof in a downwardly sloping manner over a gutter, a plurality of apertures extending through the surface of said member, said apertures being distributed on the surface of said member, the improvement comprising means for damming rainwater flowing to said member and blocking said rainwater from flowing over said member attached to said member, said planar base member being attached to each of said end members and clamped securely to said assembly wherein said means directs said rainwater along said planar base member towards each of said end members.

2. In a drain and gutter assembly comprising a planar base member having an inner edge adjacent a roof and outer edge away from said roof and having upper and lower surfaces and adapted to be installed on a roof in a downwardly sloping manner over a gutter, a plurality of apertures extending through the surface of said member, said apertures being distributed throughout the surface of said member, the improvement comprising means for blocking water from flowing over said outer edge and re-directing said water accumulating on said member toward a down pipe.

3. In a drain and gutter assembly comprising a planar base member clamped securely to said assembly and having an inner edge adjacent a roof and outer edge away from said roof and having upper and lower surfaces and adapted to be installed on a roof in a downwardly sloping manner over a gutter, a plurality of apertures extending through the surface of said member, said apertures being distributed throughout the surface of said member, the improvement comprising a flange adapted to block the flow of rainwater over said outer edges, said flange extending substantially upright from said base member and connected to the outer edge of said base member.

4. The drain and gutter assembly according to claim 3 wherein said base member and said flange are one piece.

5. The drain and gutter assembly according to claim 4 further comprising an attachment means for attaching said base member to said gutter.

6. The drain and gutter assembly of claim 5 wherein said attachment means comprises an L-shaped clip interconnecting said base member to said gutter.

7. The drain and gutter assembly of claim 6 wherein said attachment means further comprises a plurality of slots along the outer edge of said base member and wherein said clip consists of flexible, resilient plastic.

8. The drain and gutter assembly of claim 7 wherein said clip has a contour adapted to fit firmly against the leading edge of said gutter, and a head adjacent to said base member.

9. The drain and gutter assembly of claim 8 wherein said clip is adapted to be inserted through a slot in said base member.

10. The drain and gutter assembly of claim 9 wherein the head of said clip is larger than each of said slots.

* * * * *